United States Patent [19]

McDougall

[11] 4,434,587

[45] Mar. 6, 1984

[54] DUST SHROUD FOR AN ABRADING TOOL

[75] Inventor: Robert J. McDougall, Brockville, Canada

[73] Assignee: Black & Decker Inc., Newark, Del.

[21] Appl. No.: 298,312

[22] Filed: Sep. 1, 1981

[51] Int. Cl.[3] ..... B24B 23/06; B24B 55/06

[52] U.S. Cl. ..... 51/170 MT; 51/273

[58] Field of Search ..... 51/170 MT, 170 T, 170 TL, 51/170 R, 273, 134.5 F; 24/201 C, 16 PB

[56] References Cited

U.S. PATENT DOCUMENTS

| | | | |
|---|---|---|---|
| 2,764,852 | 10/1956 | Emmons . | |
| 2,929,177 | 3/1960 | Sheps | 51/273 |
| 3,592,428 | 7/1971 | McFarlane | 24/16 PB |
| 3,864,784 | 2/1975 | Kilstrom | 51/170 MT |
| 3,938,283 | 2/1976 | Keith | 51/170 MT |
| 4,075,793 | 2/1978 | Vogel | 51/170 MT |

FOREIGN PATENT DOCUMENTS

| | | | |
|---|---|---|---|
| 2239850 | 2/1975 | France | 51/170 TL |

*Primary Examiner*—Roscoe V. Parker

*Attorney, Agent, or Firm*—R. B. Sherer; H. Weinstein; Charles E. Yocum

[57] ABSTRACT

A turbine-driven sander includes a relatively thin, one-piece resilient dust shroud having a skirt surrounding a sander housing. The skirt has a rear wall which is split to form two opposing end portions, which are releasibly connected at an integral joint. The skirt has a front wall including a nozzle cover portion, and a pair of side walls having inwardly-extending lips. When attached to the housing the skirt sealingly engages the housing and creates a passage for dust-entrained air to flow from a platen to the nozzle. The air then flows to the turbine, eventually being exhausted into a source of vacuum.

7 Claims, 14 Drawing Figures

DUST SHROUD FOR AN ABRADING TOOL

CROSS-REFERENCE TO RELATED APPLICATION

The subject matter of this patent application is related to that disclosed in U.S. patent application Ser. No. 298,308, filed on Sept. 1, 1981, now U.S. Pat. No. 4,414,781 for a Turbine Sander, and assigned to the same assignee as the present application.

BACKGROUND OF THE INVENTION

1. Field of the Invention

This invention relates to air-powered tools, and more particularly to a hand-held turbine-driven orbital sander having a one-piece resilient dust shroud which has a wrap-around skirt split along a rear wall into two end portions. The end portions are releasably interconnected in an integral joint to permit attachment and disengagement from the sander.

2. Description of the Prior Art

Skirts for pad sanders have included those which have multi-piece walls requiring fasteners to connect the skirts to the housing. An example of this teaching is shown by U.S. Pat. No. 2,764,852. One-piece skirts, on the other hand have been continuous walls, unbroken by any joints. This category includes U.S. Pat. No. 2,929,177, which illustrates a one-piece skirt having lugs and tabs for positioning and attaching the skirt to the sander. Also in the category is U.S. Pat. No. 3,938,283, which shows a one piece elastic skirt which must be stretched to be attached to the sander housing.

SUMMARY OF THE INVENTION

A relatively thin, resilient one-piece dust shroud is split along a rear wall into two end portions. The shroud's wrap-around skirt is placed over a sander housing, and the end portions are snapped together at an integral joint, holding the shroud in place on the housing. The shroud's construction requires no fasteners, and enhances opportunities for mass production and rapid attachment to the sander.

It is an object of the present invention to provide a dust shroud for a turbine-driven tool which overcomes the prior art disadvantages; which is simple, economical and reliable; which includes a one-piece resilient skirt detachably mounted on a housing of a pad sander; which skirt has an end wall which is split into two end portions; which includes integral connecting means for releasably and securely connecting the end portions so that the skirt surrounds the housing; which skirt has a front wall; which includes a nozzle cover portion; which skirt also has two side walls having inwardly-extending flanges sealingly engaging an internal ledge formed in the sides of the housing; which skirt forms a passage for conveying dust-laden air form a platen to the nozzle, which air is eventually exhausted from the turbine to a source of vacuum.

Other objects and advantages will be apparent from the following description of one embodiment of the invention; the novel features will be particularly pointed out hereinafter in the claims.

BRIEF DESCRIPTION OF THE DRAWINGS

The invention is illustrated in the accompanying drawings in which.

FIG. **12*a*** is a rear elevational detail view of the dust shroud of the present invention, illustrating the partial connection of the joint.

FIG. **12*b*** is a rear elevational detail view of the dust shroud of the present invention, showing the joint connected.

Figure 10:
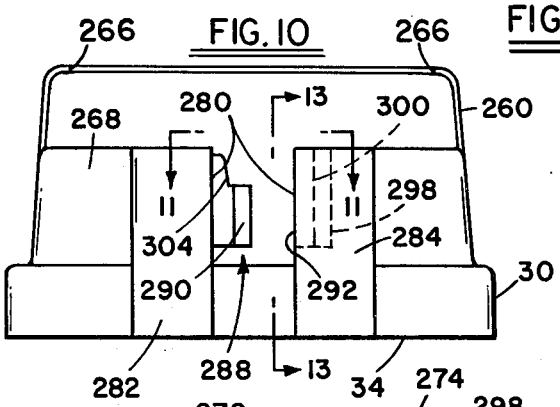
FIG. 10 is a rear elevational detail view of the dust shroud of the present invention.
Figure 13:
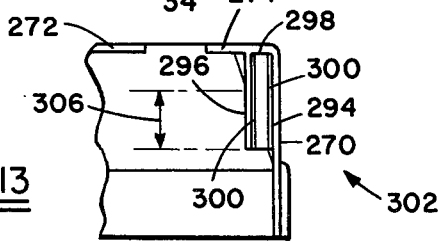

FIG. 13 is an enlarged elevational detail view taken along line 13—13 of FIG. 10.

DESCRIPTION OF THE PREFERRED EMBODIMENT

Figure 1:
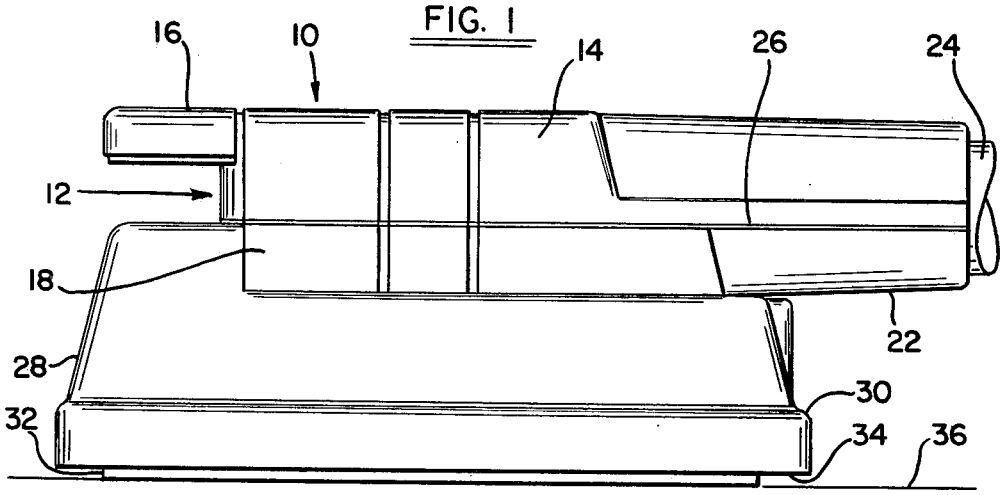
FIG. 1 is a side elevational view of a sanding tool embodying the present invention.
Figure 2:
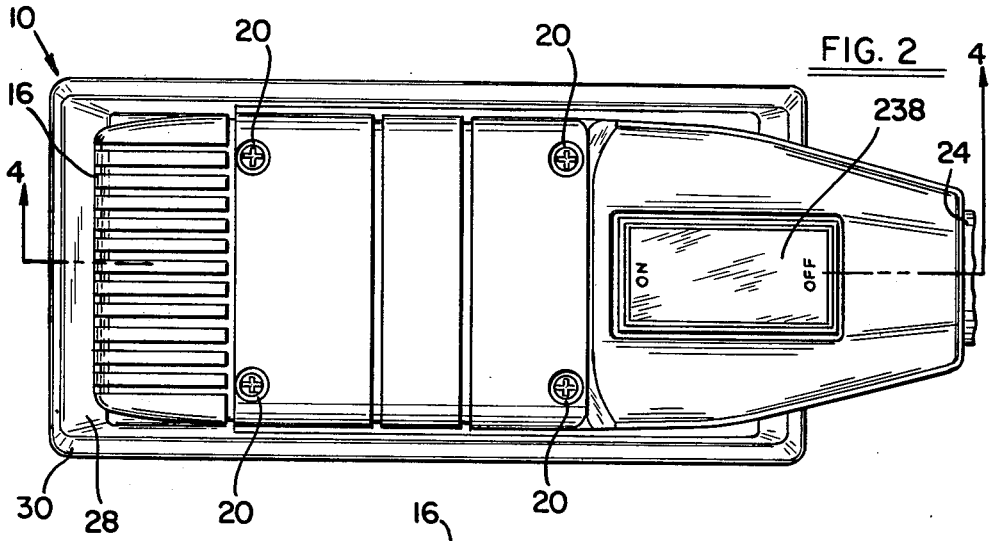
FIG. 2 is a plan view of the sanding tool embodying the present invention.
Figure 3:
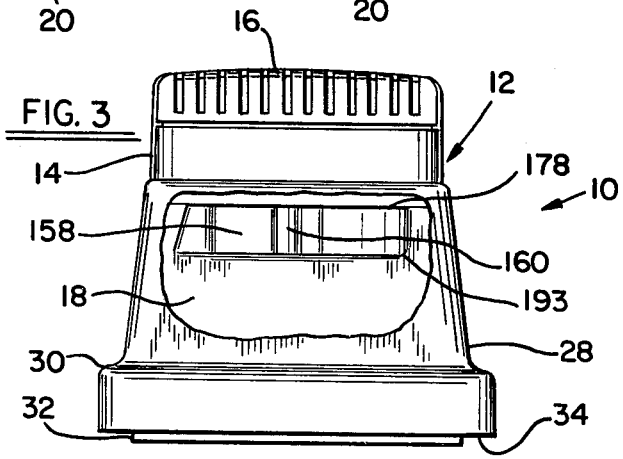
FIG. 3 is a front elevational partially cutaway view of the sanding tool of FIG. 1.

Referring to FIGS. 1, 2 and 3, a turbine-powered orbital sander referred to generally as 10 is shown embodying the present invention. A streamlined exterior sander housing assembly 12 includes three one-piece molded plastic members. The first member, an upper handle 14 having a ribbed front handgrip 16, is secured to the second member, a lower housing 18, by fasteners 20. The third member is a tapered vacuum line receptacle 22 mounted beneath the rear of the upper handle 14, and connected to a fitting 24 of an air hose leading to a vacuum source (not shown). The three housing members 14, 18 and 22, are joined along a common boundary 26. A one-piece dust shroud 28 is mounted on the lower housing 18. The dust shroud 28 has a flared portion 30 which is spaced outwardly from platen 32 so that a bottom edge 34 of the shroud 28 is suspended just above worksurface 36.

Figure 4:
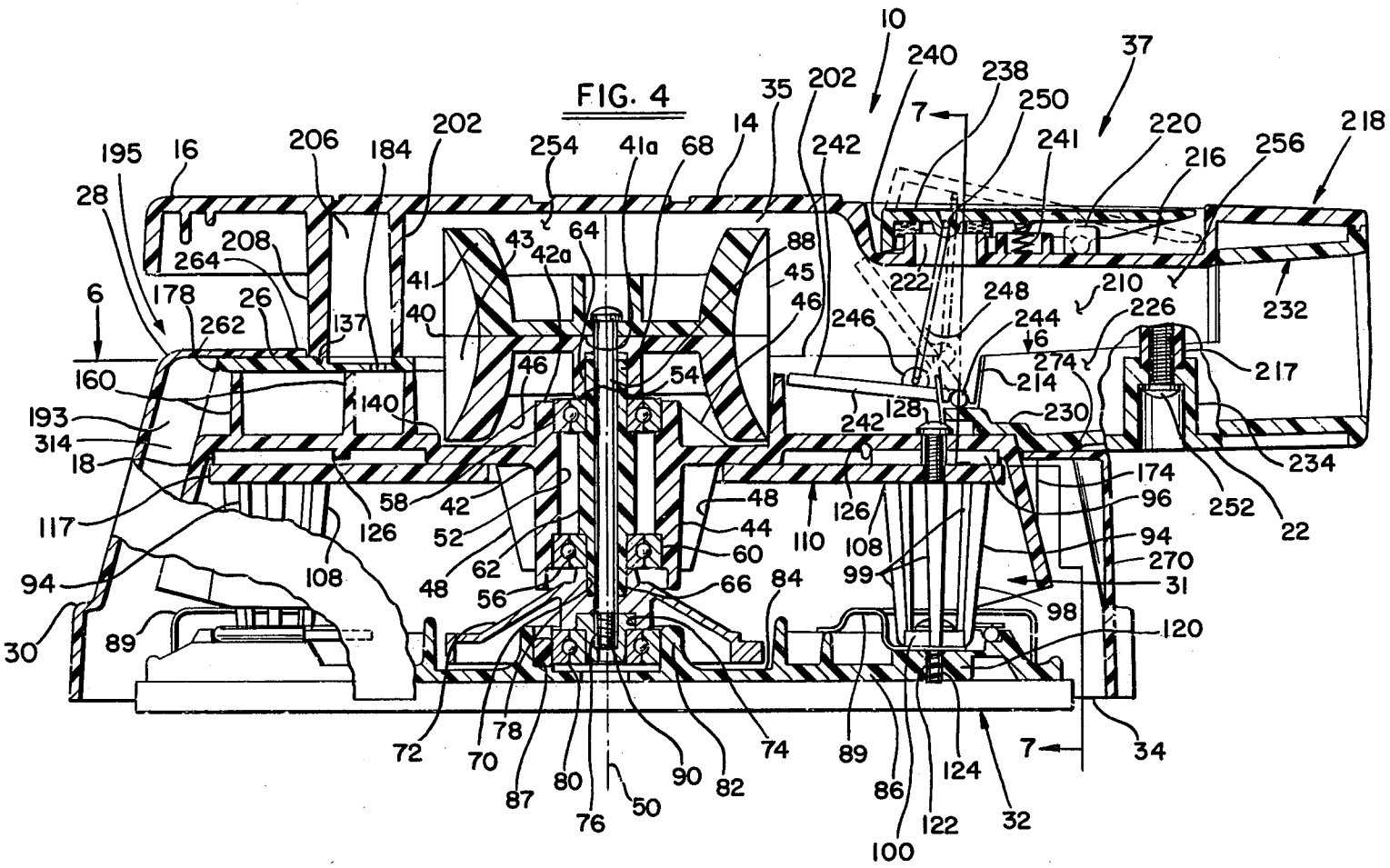
FIG. 4 is a side elevational sectional view, partially cutaway, taken along line 4—4 of FIG. 2.
Figure 5:
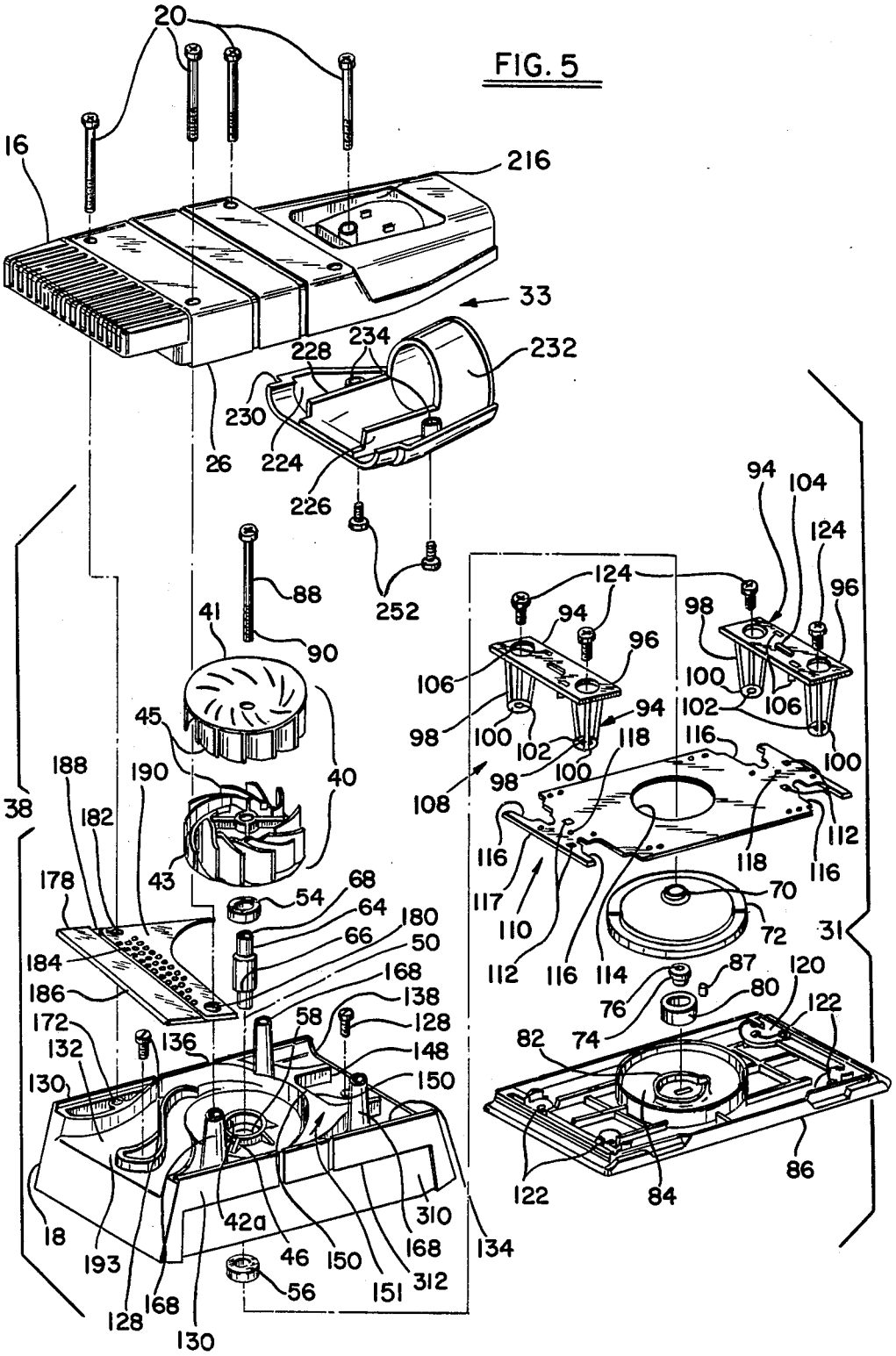
FIG. 5 is an exploded perspective view of the sanding tool.

As shown in FIGS. 4 and 5, housing assembly 12 encloses several systems which coact to produce the present sander 10. A flexible, four-point suspension system 31 supports the sander housing 12, which encloses an easily-assembled interfit system 33. The interfit system 33 defines a set of air chambers 35 which guide air flow to a switching system 37 with a minimum of turbine noise. The switching system 37 permits the operator to quickly engage and disengage a turbine direct drive system 38, without having to connect and disconnect the sander 10 and the fitting 24. When engaged, the drive system 38 interacts with the suspension system 31 to yield the sander's oscillating motion. After these systems are described, the dust shroud 28 will be set forth in greater detail.

The first system to be described is the turbine direct-drive system 38. FIGS. 4, 5 illustrate a turbine 40 constructed of a turbine upper half 41 interlocked as at **41*a*** with a turbine lower half 43. A plurality of turbine vanes 45 are configured such that air entering the turbine lower half 43 exits from the turbine upper half 41.

The turbine 40 is mounted in the housing assembly 12 using a minimum of components. A hub 42 is formed with an upper hub portion 42*a* and a lower hub portion 44, which are integrally molded on the lower housing 18. A plurality of upper ribs 46 and lower ribs 48 are also integrally molded on lower housing 18 and provide additional support for hub 42. The hub 42 is located concentrically about a turbine axis 50, and defines a bore 52, also located concentrically about the turbine axis 50. Upper and lower ball bearings 54, 56 are pressed into upper and lower counterbores 58, 60, respectively, in bore 52 such that their respective axes of rotation are coincident with turbine axis 50.

A one-piece thermoplastic shaft 62 has a reduced diameter upper portion 64 and a similar reduced diameter lower portion 66. The shaft 62 defines a longitudinal clearance bore 68. Upper and lower portions 64, 66 are mounted in bearings 54, 56, respectively, such that the longitudinal centerline of clearance bore 68 is coincident with turbine axis 50. The turbine 40 is mounted onto the upper portion 64 of shaft 62; a top 70 of counterweight 72 is mounted onto the lower portion 66. Therefore the one-piece shaft 62 and its support structure provides a rapid alignment of counterweight 72 with turbine 40, along the turbine axis 50.

A bushing 74, shown in FIGS. 4, 5 having a threaded bore 76 is eccentrically located into a counterweight hub 78. The bushing 74 is pressed into a counterweight bearing 80, having an axis of rotation coincident with the turbine axis 50. Bearing 80 is mounted in a hub 82 formed on upper surface 84 of a baseplate 86, and is trapped therein by plug 87. Platen 32 is attached to the baseplate 86.

The drive system 38 is assembled by inserting an elongated machine screw 88, having a threaded end 90 through the turbine 40, clearance bore 68, and counterweight 72, and into threaded engagement with bore 76 of bushing 74. When the screw 88 is tightened, it adds rigidity to the drive system components by placing them in slight compression.

The resultant drive system 38 is now aligned about a single axis 50. As turbine 40 rotates, it rotates shaft 62 and bushing 74, which in turn drives counterweight 72 and baseplate 86, thereby providing an oscillatory sanding motion to platen 32. An abrasive strip or sandpaper is attached to baseplate 86 via clamps 89, which are of conventional designs.

In addition to being connected to the baseplate 86 through the drive system 38 as described above, the lower housing 18 is supported upon the baseplate through the four-point suspension system 31, which provides both support and flexibility so that the suspension system 31 coacts with the drive system 38 to distribute the orbital sanding action about the platen 32.

The suspension system 31 includes two platen support members 94 as best seen in FIG. 5. Each platen support member 94 is a molded plastic body in the shape of an inverted "U" in which a flat cross-member 96 supports at each end a flexible post 98. Post 98 includes a plurality of downwardly extending flexible fingers 99 terminating in a disc 100 having a mounting hole 102. A longitudinal mounting slot 104 is formed in the cross-member 96 midway between each flexible post 98. Two downwardly-extending locking tabs or snaps 106 are formed diagonally between the flexible posts 98 and the mounting slot 104. Again referring to FIG. 5, a suspension subassembly 108 is created when two platen support members 94 are temporarily connected to a mounting member, such as a metal mounting plate 110. The metal mounting plate 110 has four locking apertures 112 so spaced as to receive the snaps 106 of the flexible post pairs 94. The metal mounting plate 110 also includes a central clearance orifice 114, four corner cutouts 116, which extend in pairs towards each other from opposite sides adjacent the end 117 thereof, and a threaded mounting hole 118 formed inwardly of the end 117. The subassembly 108 is completed when the two platen support members 94 are snapped into the apertures 112 of the metal plate 110. The subassembly 108 now can be easily moved to and aligned with the other components of the suspension system 31 and the drive system 38.

During final assembly of the suspension system 31, subassembly 108 is attached to the baseplate 86 and then to the upper housing 18. A raised boss 120, shown in FIGS. 4 and 5, having a threaded aperture 122 is formed at each corner of the upper surface 84 of baseplate 86. A fastener 124 is inserted through each disc mounting hole 102 and into threaded engagement with each aperture 122 of baseplate 86. The subassembly 108 is then positioned against the lower housing 18 such that the cross-member 96 of each platen support member 94 is located in a mating recess 126 formed beneath the lower housing 18, and clearance orifice 114 is placed around ribs 48. Then a pair of fasteners 128 are inserted through the lower housing 18, the mounting slot 104, and into threaded engagement with holes 118 of metal plate 110, the slot 104 enhancing ease of alignment. When fasteners 128 are tightened they secure the platen support members 94 to the lower housing 18 by firmly sandwiching the platen support members 94 between the metal plate 110 and the lower housing 18. The drive system 38 is now axially entrapped therebetween but is free to rotate about the axis 50. Nevertheless, when the baseplate 86 is vibrated responsive to the orbital motion of the drive system 38, the flexible posts 98 of the suspension system 31 flex to accommodate such motion, while maintaining the axial distance of the drive system 38.

Having described the drive system 38 and suspension system 31, it is now appropriate to describe how a minimum of housing components interfit to guide and control air flow and to abate turbine noise, thereby powering the drive system 38.

Figure 6:
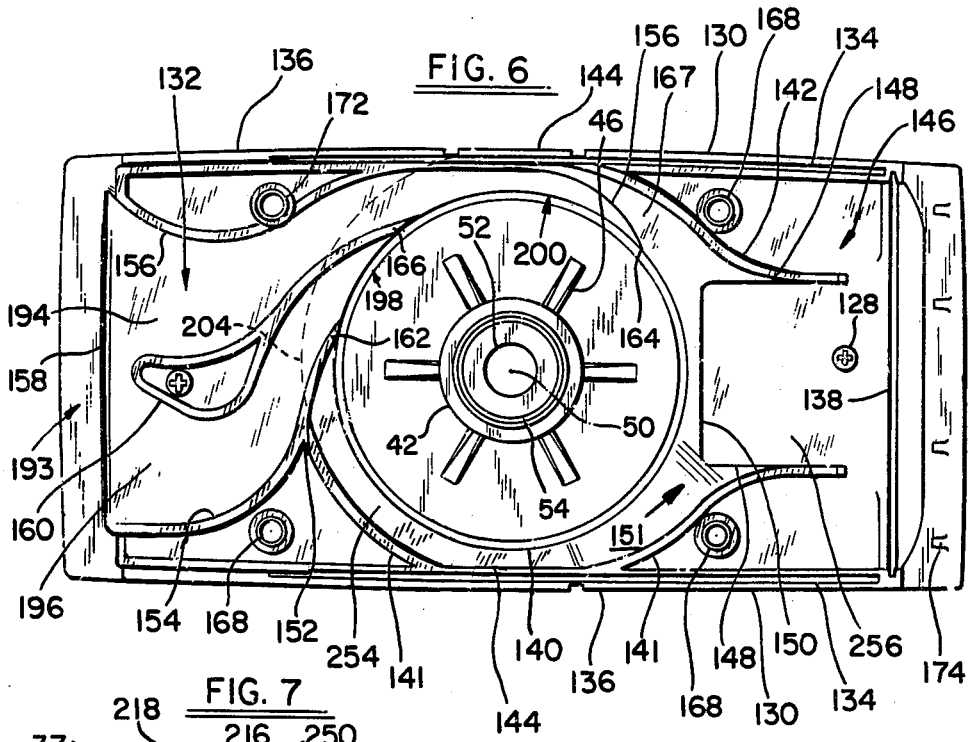
FIG. 6 is a detail plan view of a lower housing member, taken along line 6—6 of FIG. 4.

Referring to FIGS. 4, 5 and 6, the lower housing 18 has two longitudinal integrally-molded exterior walls 130 of uniform height extending from a lower housing floor 132 to the plane of the common boundary 26. A shallow groove 134 is formed in the upper edges 136 of the walls 130 to accommodate a complementary peripheral sealing tongue 137 on upper handle 14. A similar shallow groove 138 is also formed in the floor 132 transverse to and intersecting the groove 134.

As shown in FIG. 6, a circular lower turbine well 140 is formed concentrically about turbine axis 50. Two sections 141, 142 of a curved turbine chamber wall merge with the exterior walls 130 at its midpoints 144, and curve inwardly to the exhaust end 146 of the lower housing 18, where they join switch chamber side walls 148. Walls 148 extend transversely to and rearwardly from switch chamber wall 150. The floor 132 slopes upwardly between wall 141 and well 140, as indicated by arrow 151 of FIG. 6. Wall 141 extends forwardly until it reaches junction 152 with a first nozzle wall 154.

Nozzle wall 154 and a second nozzle wall 156 form the sides of a turbine air inlet 158 (see FIG. 3). A nozzle air-dividing wall 160 is located generally intermediate the nozzle walls 154, 156. All three nozzle walls 154, 156, 160 describe "S"-shaped paths converging rearwardly of the turbine air inlet 158. Walls 154 and 156 intersect the lower turbine well 140 at junctions 162, 164 respectively. Wall 160 stops at a point 166 on the arc intermediate the intersections 154, 156. A horizontal platform 167 is formed between nozzle wall 156 and turbine chamber wall 142, and merges with upward slope 151 of floor 132.

For strength and ease of alignment and assembly, three upwardly-extending, generally conical posts 168 are molded into the floor 132, as shown best in FIG. 5, and make up three support members of the housing interfit system 33. A short boss 172 extends upwardly to approximately the height of nozzle wall 156, as shown in FIGS. 5 and 6.

To complete the structure of lower housing 18 a plurality of vertical ribs 174 are formed on a rear surface 176 of the lower housing 18, thereby supplying additional support for the dust shroud 28.

As shown in FIGS. 4 and 5, a sub-element of the interfit system 33 is a nozzle cover plate 178, in each side of which are formed large and small mounting holes 180, 182, respectively. A plurality of noise attenuation holes 184 are formed in the cover plate 178 generally intermediate the mounting holes 180, 182. Forwardly of the noise attenuation holes 184 is a generally rectangular front section 186, in which is also formed a continuation 188 of the groove 134. A generally arcuate section 190 of the cover plate 178, having a flashed edge 192, extends rearwardly of the noise attentuation holes 184, adjacent the small mounting hole 182.

As shown in FIGS. 5 and 6, when the nozzle cover plate 178 is assembled on the lower housing 18, the large mounting hole 180 is placed over one of the posts 168, the small mounting hole 182 is positioned over boss 172, and flashed edge 192 is placed over points 162, 164 and 166 along the arc of the turbine well 140. Then the cover plate 178 is lowered onto the lower housing 18. The resultant structure is an inlet nozzle 193 having two channels 194, 196 which direct air to two entrances 198, 200 respectively, along the lower turbine well 140. The flashed edge 192 provides an air seal at the entrances 198, 200. The inlet nozzle 193 is one element of a turbine noise attenuation subsystem, shown generally as 195 in FIG. 4.

Referring to FIGS. 4 and 6 another interfit member is upper handle 14, which includes a second element of the noise attenuation subsystem 195. Handle 14 defines a generally circular wall 202, which follows a continuous contour traced by turbine chamber walls 141, 142 and the curve 204 shown in FIG. 6 (in phantom). Now referring to FIG. 4, adjacent the handgrip 16, a rectangular side branch resonator 206 is located between the circular wall 202 and exterior wall 208. A downwardly-extending post (not shown), similar to the upwardly extending posts 168, is recessed in the upper handle 14 adjacent the side branch resonator 206, such that it complements boss 172 of lower housing 18. This post is the fourth support member for the interfit system 33.

As shown in FIG. 4, when the upper handle 14 is assembled to the lower housing 18, the side branch resonator 206 is positioned over the noise attenuation holes 184 of the inlet nozzle 193. The noise attenuation holes 184 and side branch resonator 206 coact to minimize turbine noise; this combination in turn coacts with the inlet noise-attenuating nozzle 193 to provide the turbine noise attenuation subsystem 195.

Figure 7:
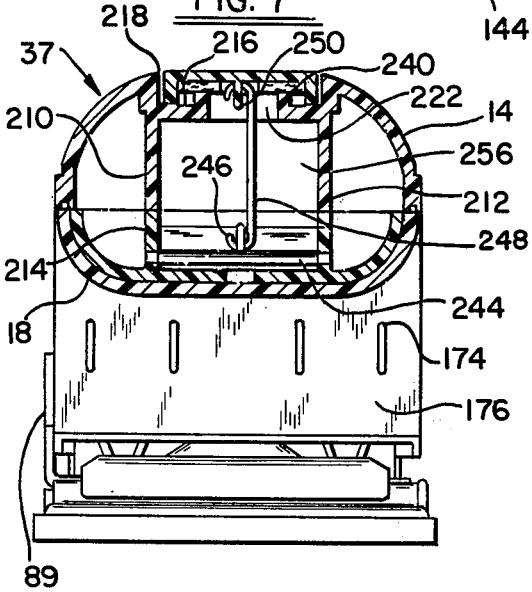
FIG. 7 is a rear elevational view, partly in section, taken along line 7—7 of FIG. 4.

The interfit system 33 also provides structure for mounting the switching system 37. Referring to FIGS. 4 and 7, wall 202 extends rearwardly, becoming two parallel upper switch chamber walls 210, 212. Between each wall 202, 210 and wall 202, 212, is located a downwardly extending tab 214.

Now referring to FIGS. 4, 5 and 7, a toggle well 216 is formed in the upper surface 218 of the upper handle 14. Toggle pivot brackets 220 are formed in each side of the toggle well 216, and a bypass aperture 222 is located in well 216 forwardly of the toggle pivot brackets 220. Two downwardly-extending internally threaded posts 217 are located between walls 210 and the outer wall of upper handle 14.

The final element of the interfit system 33 is the tapered receptacle 22, which includes a clamshell base 224 upon which are formed walls 226, 228. A stepped portion 230 is located forwardly of walls 226, 228. An integral tapered hoop portion 232 extends upwardly and rearwardly of the walls 226, 228 and is sized to tightly accommodate air hose fitting 24 (FIGS. 1 and 2). Two hollow bosses 234 extend upwardly between the walls 226, 228 and the clamshell base 224.

Again as shown FIG. 4, a switching system 37 includes a toggle lever 238 pivotally mounted on brackets 220 such that its upper surface is flush with the upper surface of upper handle 14. The toggle lever 238 is marked "on" at its forward position, and "off" at its rearward position (FIG. 2). Referring to FIG. 7, a felt gasket 240 is mounted on the underside of the toggle lever 238 above the bypass aperture 222, serving as an air seal. A coil spring 241 between the upper handle 14 and the toggle lever 238 normally biases the switch 236 "off", as shown in phantom in FIG. 4. A flap valve 242 has a integral pivot rod 244 at is rearmost end, and is pivotally connected at 246 to a connecting rod 248, which itself is pivotally connected at 250 to the toggle lever 238.

To assemble the interfit system 33 the switching system 37 is mounted in the upper handle 14 such that the flap valve pivot rod 244 is located immediately below tabs 214. Tapered receptacle 22 is then positioned such that pivot rod 244 is trapped between tabs 214 and stepped portion 230, hollow bosses 234 are adjacent posts 217, and hoop portion 232 is nested within the rear of the upper handle 14. Fasteners 252 complete the connection between the upper handle 14 and tapered receptacle 22. The upper handle 14 is then positioned above lower housing 18 such that resonant chamber 206 is above the holes 184 in nozzle cover plate 178, the downwardly extending post (not shown) is placed immediately above small mounting hole 182, and stepped portion 230 of the tapered receptacle 22 covers rear groove 138. Fasteners 20 are then inserted through the upper handle 14 downwardly into the small mounting hole 182 and the three vertical posts 168, threadedly engaging mounting plate 110.

Figure 8:
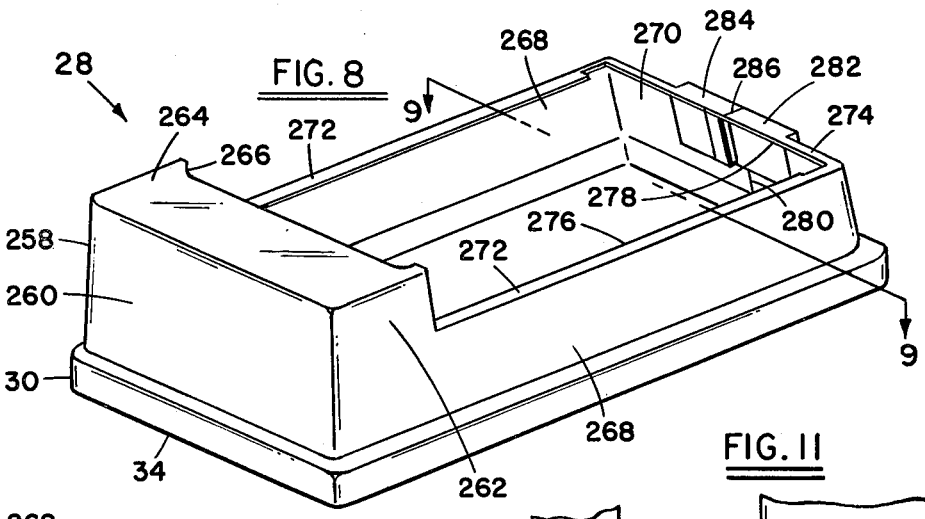
FIG. 8 is a perspective view of the dust shroud of the present invention, with the joint connected.

The complete interfit system 33 provides a quickly-assembled, sealed set of air chambers, as follows: The upper handle wall 202 mates with lower housing walls 141, 142 to form a turbine chamber 254. Walls 210, 212 of the upper handle 14 mate with walls 148 of the lower housing 18 and walls 214 of the receptacle 22; together with wall 150, the resultant structure forms a valve chamber 256. The dust shroud 28 may now be attached to the sander 10. As shown in FIG. 8, the dust shroud 28 is a one-piece wrap-around skirt 258 composed of relatively thin, resilient plastic. The skirt 258 includes a front wall 260 having a nozzle cover portion 262. The nozzle cover portion 262 includes an inwardly-extending lip 264 having an edge 266 contoured to sealingly engage the housing 12 of the sander 10. The skirt 258 also includes a pair of longitudinal side walls 268 and a rear wall 270, having inwardly extending lips 272, 274, respectively which also have edges 276, 278 respectively sealingly engaging the housing 12. The walls 260, 268, 270 are also contoured to complement the streamlined exterior housing assembly 12.

The rear wall 270 is split at 280 into two end portions, 282, 284, which when connected as shown in FIG. 8, form an integral joint 286 which releasably and securely connects the end portions 282, 284.

Figure 9:
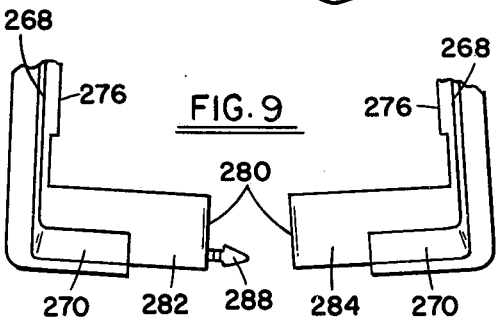
FIG. 9 is an enlarged cutaway detail view taken along line 9—9 of FIG. 8, with the joint disconnected.
Figure 11:
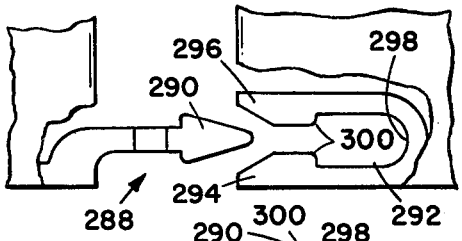
FIG. 11 is an enlarged partially cutaway detail view in plan taken along line 11—11 of FIG. 10.

Referring to FIGS. 9 and 10, the joint 286 has been disconnected and the resilient dust shroud 21 opened a small amount, spreading the end portions 282, 284. The joint 286 includes connecting or interlocking means 288. Referring to FIGS. 9, 10, and 11, the interlocking means 288 includes a vertically extending tongue or wedge 290 having an arrowhead cross-section which engages a mating, open-bottomed, vertically-extending groove or receptacle 292. The receptacle 292 is formed by an outer wall 294 integral with the rear wall 270 of the skirt 258. A resilient inner wall 296 is jointed at 298 to the outer wall 294 and flexes when wedged apart by wedge 290. Detents 300 are formed on the outer and inner walls 294, 296 and lock wedge 290 when wedge 290 is snapped into receptacle 292.

Reffering to FIGS. 10, 12*a*, 12*b*, and 13, a means for aligning the end portions 282, 284 to provide for a rapid connection is shown generally as 302. The wedge 290 is offset downwardly from the lip 274 of the rear wall 270 a predetermined distance 304. The inner resilient wall 296 of the receptacle 292 flexes increasingly as it extends outwardly from its joint 298 with outer wall 294, creating a connection zone 306, as seen in FIG. 13. If the operator attempts to insert the wedge 290 above the connection zone 306, the resilient inner wall 296 will not flex enough to permit penetration by the wedge 290.

Figure 12A:
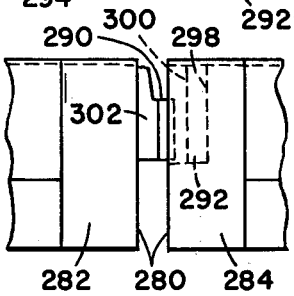
Figure 12B:
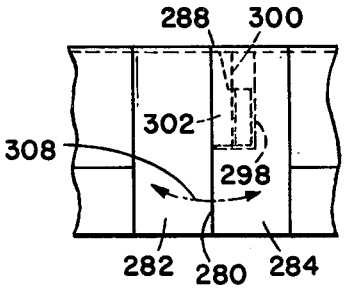

FIGS. 12*a* and 12*b* illustrate the sequence of engagement when the wedge 290 is correctly aligned with the connection zone 306 of receptacle 292, thereby aligning the end portions 282, 284 of the skirt 258.

To open the joint 386 the operator rotates end portion 282, 284 apart as shown by arrow 308 in FIG. 12*b*. The joint 206 can also be opened and closed by sliding the wedge 290 vertically downwardly and upwardly, respectively, into the receptacle 292.

The dust shroud 28 is attached to the sander 10 by opening the joint 286, spreading the end portions 282, 284 of the skirt 258 slightly, then lowering the shroud 28 upon the housing assembly 12. Referring to FIG. 5, each side of the lower housing 18 includes an elongated recess 310, which creates an internal ledge 312 therewith. Now referring to FIGS. 1, 4 and 5, when the shroud 28 is lowered into place, the nozzle cover portion 262 and lip 264 overlie the nozzle 193, at a higher elevation than the rest of the shroud 28, creating an air passage 314 from the platen to the nozzle 193. The lips 272 of the shroud side walls 268 sealingly engage the internal ledge 312 in the lower housing 18. This produces the streamlined appearance illustrated in FIG. 2, the shroud side walls 268 being substantially flush with the exterior housing 12. The lip 274 of the shroud rear wall 270 engages the protrusions or ribs 174 of the lower housing 18. The shroud lip edges 266, 276, 278 engage the housing 12 to provide an air seal to maintain dust-laden air inside the shroud until it is conveyed as shown in FIGS. 4 and 5, via the air passage 314 to the nozzle 193.

When the operator connects the end portions 282, 284 at the rear 176 of sander lower housing 18, the housing ledges 312, ribs 174, and nozzle 193 provide a locating means for positioning the shroud 28 and for holding it in place. The dust shroud air passage 314, nozzle 193, turbine chamber 254 and valve chamber 256 now provide a sealed path for dust-laden air to travel from the platen 32 to the vacuum source. However, the sander 10 may be operated without the dust shroud 28 in place. The operator reverses the attaching steps, and now disconnects the shroud end portions 282, 284, spreads them apart slightly, and lifts the dust shroud 28 from the exterior housing 12.

Therefore, in operation, when the sander is connected to a vacuum source, and toggle lever 238 is depressed "on", air travels inwardly through nozzle passages 194, 196 into the turbine chamber 254. As air drives turbine 40, the air moves upwardly and is exhausted through valve chamber 258, into the vacuum source. As seen in FIG. 6 the slope 151 in the floor 132 provides a "scavenging" effect in the turbine chamber 254, as follows: If any air collects in the pockets in the turbine chamber, the airflow from the turbine chamber 254 is guided upwardly along slope 151 to the valve chamber 256 and breaks up the pockets or prevents their formation, thereby improving the tool's efficiency. When lever 238 is turned "off", air enters through the bypass aperture 222, flap valve 242 is closed, and the turbine 40 stops.

It will be understood that various changes in the details, materials, arrangements of parts and operating conditions which have been herein described and illustrated in order to explain the nature of the invention may be made by those skilled in the art within the principles and scope of the invention.

What is claimed is:

1. A dust shroud for a sanding tool having a housing, comprising:

(a) a one-piece resilient skirt having a wall extending about the periphery of the housing;

(b) said skirt wall being split into two end portions terminating in transverse edges in opposing end-to-end abutting alignment defining a joint;

(c) the wall further having an upper edge; and (d) the joint including connecting means integrally formed on said end portions adjacent said transverse edges for aligning said end portions during their connection and for enabling rapid disconnection by their counterrotation in a single plane outwardly from each other about a point defined by the intersection of said joint with said wall upper edge.

2. The dust shroud claimed in claim 1, wherein:

(a) said connecting means including a receptacle formed in one end portion and a wedge formed in the other end portion for insertion in said receptacle;

(b) the receptacle being defined by an outer wall integral with the wall of the skirt and a resilient inner wall connected parallel to said outer wall at a joint and extending downwardly from said joint;

(c) the inner wall of the receptacle being increasingly flexible as it extends from said joint; and (d) said outer and inner receptacle walls including detents cooperating with said inserted wedge.

3. A dust shroud for a sanding tool having a housing, comprising:

(a) a one-piece resilient skirt having a wall extending about the periphery of the housing;

(b) said skirt wall being split into two end portions in opposing abutting alignment defining a joint;

(c) the wall further having an upper edge;

(d) the joint including connecting means integrally formed on said end portions for aligning said end portions during their connection and for enabling rapid disconnection by their counterrotation in a single plane outwardly from each other about a point defined by the intersection of said joint with said wall upper edge;

(e) said connecting means including a receptacle formed in one end portion and a wedge formed in the other end portion for insertion in said receptacle;

(f) the receptacle being defined by an outer wall integral with the wall of the skirt and a resilient inner wall connected parallel to said outer wall at a joint and extending downwardly from said joint;

(g) said receptacle walls extending a predetermined distance downwardly from said upper edge of said skirt wall;

(h) the inner wall of the receptacle being increasingly flexible as it extends from said joint;

(i) said receptacle defining a connection zone at the lower end portion thereof wherein said inner receptacle wall being most resilient;

(j) said wedge being incapable of connection with said receptacle above said connection zone; and (k) said outer and inner receptacle walls including detents cooperating with said inserted wedge.

4. The dust shroud claimed in claim 3, wherein:

(a) said wedge having a predetermined length and having an arrowhead cross-section;

(b) said connection zone having a length approximately equal to said wedge length;

(c) said wedge being offset downwardly a predetermined distance from said upper edge of said skirt; and (d) said predetermined distance being sufficient to permit said wedge to penetrate said connection zone when said upper edges of said end portions are in abutting alignment.

5. An abrading tool, comprising:

(a) a housing having two sides, each defining a shallow elongated recess;

(b) said recess further defining an elongated planar upper internal ledge;

(c) a dust shroud including a one-piece resilient skirt having a wall extending about the periphery of the housing;

(d) said skirt wall being split into two end portions in opposing abutting alignment defining a joint;

(e) the wall further having an upper edge;

(f) the skirt wall having two side walls;

(g) a planar lip extending transversely inwardly from the upper edge of each of said two side walls;

(h) each planar lip sealingly engaging a respective planar upper internal ledge, the skirt side walls being substantially flush with said housing to generate a streamlined appearance; and (i) the joint including connecting means integrally formed on said end portions for aligning said end portions during their connection and for enabling rapid disconnection by their counterrotation in a single plane outwardly from each other about a point defined by the intersection of said joint with said wall upper edge.

6. An abrading tool, comprising:

(a) a housing having two sides, each side defining a shallow elongated recess, which recess defining an elongated internal ledge;

(b) the housing further including a rear portion having a plurality of ribs formed thereon, and a front portion including a nozzle;

(c) a dust shroud including a one-piece resilient skirt having a wall extending about the periphery of the housing;

(d) said skirt wall being split into two end portions in opposing abutting alignment defining a joint;

(e) the skirt wall further defining an upper edge, two side walls, and a front wall and a rear wall;

(f) the joint including connecting means integrally formed on said end portions for aligning said end portions during their connection and for enabling rapid disconnection by their counterrotation in a single plane outwardly from each other about a point defined by the intersection of said joint with said skirt wall upper edge;

(g) a skirt side wall lip extending transversely inwardly from the upper edge of each of said two side walls, each skirt side wall lip engaging a respective internal ledge, the skirt side walls being substantially flush with said housing to generate a streamlined appearance;

(h) a lip extending inwardly from the upper edge of said skirt front wall and rear wall; and (i) said front wall lip resting upon said nozzle and said rear wall lip resting upon said ribs.

7. The dust shroud claimed in claim 6, wherein:

(a) said nozzle being at a higher elevation than said internal ledge; and (b) said skirt front wall lip being at a higher elevation than said skirt side wall lips.

* * * * *